US006373004B1

(12) United States Patent
Jackson

(10) Patent No.: US 6,373,004 B1
(45) Date of Patent: Apr. 16, 2002

(54) RETAINER FOR CIRCUIT BREAKER LEVERAGE ARM

(75) Inventor: Robert Eugene Jackson, Lincoln, IL (US)

(73) Assignee: Eaton Corporation, Cleveland, OH (US)

( * ) Notice: Subject to any disclaimer, the term of this patent is extended or adjusted under 35 U.S.C. 154(b) by 55 days.

(21) Appl. No.: 09/607,148

(22) Filed: Jun. 29, 2000

(51) Int. Cl.[7] ..... H01H 9/20

(52) U.S. Cl. ..... 200/50.1; 200/43.01; 200/43.04; 200/43.16; 200/50.02; 200/331

(58) Field of Search ..... 200/17 R, 43.01, 200/43.04, 43.11, 43.14–43.16, 43.19, 43.22, 50.01, 50.02, 50.06, 50.1, 400, 293, 329–332

(56) References Cited

U.S. PATENT DOCUMENTS 5,495,388 A * 2/1996 Bonetti et al. ..... 361/609
5,577,603 A * 11/1996 Bogdanovs et al. ..... 200/331
5,663,862 A * 9/1997 Hopping-Mills ..... 361/115
5,911,316 A * 6/1999 Chu ..... 200/331
5,973,278 A 10/1999 Wehrli, III et al. ..... 200/308
6,087,602 A * 7/2000 Bernier et al. ..... 200/50.11

OTHER PUBLICATIONS

Cutler–Hammer, Eaton, *Cutler–Hammer Commercial Metering Switchboards*, File No. 31–500, pp. 1–4, (May 1997).

* cited by examiner

*Primary Examiner*—Michael Friedhofer
(74) *Attorney, Agent, or Firm*—Martin J. Moran

(57) ABSTRACT

A retention device for removably carrying a leverage arm on a switchgear cabinet includes a mounting member structured to be mounted on a housing of the switchgear cabinet and a tab structured to extend outwardly from the housing. The tab is formed with an opening that slidably receives a shank of the leverage arm therein, the opening being configured to resist movement of a head of the leverage arm through the opening. A moveable cover is positioned in relation to the retention device to retain the leverage arm on the retention device when the cover is in a closed position, yet permit the leverage arm to be removed from the retention device when the cover is in an open position.

17 Claims, 2 Drawing Sheets

RETAINER FOR CIRCUIT BREAKER LEVERAGE ARM

BACKGROUND OF THE INVENTION

Technical Field

The present invention relates generally to switchgear cabinets for circuit breakers and, more particularly, to such cabinets for circuit breakers having handles that can be engaged with removable leverage arms. Specifically, the invention relates to a switchgear cabinet having a retainer for removably carrying a leverage arm that operatively engages a circuit breaker handle.

Background Information

Electric power distribution systems typically includes one or more circuit breakers that automatically interrupt current during specific overcurrent and under-voltage conditions, as well as other conditions. Such circuit breakers typically include a plurality of stationary contacts and a plurality of moveable contacts, the moveable contacts being pivotable into and out of electrical engagement with the stationary contacts. The circuit breaker is in an "on" condition when the moveable contacts are in electrical engagement with the stationary contacts, and in such condition electricity is permitted to flow through the circuit breaker. The circuit breaker is in an "off" condition when the moveable contacts are disengaged from the stationary contacts, and in such condition current is prevented from flowing through the circuit breaker.

Circuit breakers typically include a tripping mechanism that acts upon an overcurrent condition or other specified condition to rapidly separate the moveable contacts from the stationary contacts to place the circuit breaker in the "off" condition and stop the flow of current therethrough. After the circuit breaker has been "tripped" in such a fashion, it is desirable to return the circuit breaker to the "on" condition to restore power to the electrical circuit once the cause of the overcurrent or other specified condition has been identified and rectified.

The circuit breaker typically is disposed within a cabinet of a switchgear assembly. The circuit breaker itself typically includes a handle or knob that is operatively connected with the moveable contacts and that protrudes to the outside regions of the circuit breaker and beyond the housing of the switchgear cabinet to permit a technician or other appropriate personnel to manually move the contacts between the "off" and "on" conditions and vice versa as needed. Inasmuch as circuit breakers handling large currents typically require heavy springs to assist in the engagement and disengagement of the moveable contacts with the stationary contacts, the forces required to operate the handle or knob to move the moveable contacts between the "off" and "on" conditions and vice versa can be excessive.

Leverage arms exist for use in conjunction with certain circuit breakers and provide additional leverage to the technician for such a task. Such a leverage arm is mounted on the handle that is operatively connected with an operating mechanism that manually moves the moveable contacts between the "off" and "on" conditions. The leverage arm provides the technician with additional leverage to operate the operating mechanism, according to known principles.

Such leverage arms have not, however, been without limitation. Leverage arms typically protrude outwardly from switchgear cabinetry by a given distance and thus are subject to being broken off during the course of normal activities occurring in the vicinity of the cabinetry. Leverage arms additionally can cause injury to persons walking past the cabinet without observing the leverage arm protruding outwardly therefrom. While some leverage arms may be of a detachable configuration that allows the leverage arm to be selectively detached from the handle of the circuit breaker operating mechanism, such detachable handles are subject to being lost or stolen whereby the handles would be unavailable when needed to operate the circuit breaker. As such, a need exists for an apparatus and method for retaining a detachable leverage arm for a circuit breaker in close proximity with the circuit breaker where it will be available for use when needed, yet will not be subject to theft or other loss.

SUMMARY OF THE INVENTION

In view of the foregoing, a retention device for removable carrying a leverage arm on a housing of a switchgear cabinet includes a mounting member mounted on the housing and a tab extending outwardly from the mounting member. The leverage arm includes a head and a shank, the shank being slidably disposed in an opening formed in the tab. A cover is mounted on the housing, the cover being moveable between a closed position and an open position, the cover in the closed position retaining the head of the leverage arm between the cover and the tab, and thus resisting movement of the shank from the opening. The cover in the open position permits the leverage arm to be removed from the opening in the tab.

An aspect of the present invention is to provide a switchgear cabinet, the general nature of which can be stated as including a housing, a switch disposed in the housing, the switch including a handle, a cover mounted on the housing, the cover being movable between a closed position and an open position, the cover extending outwardly from the housing, a retention device mounted on the housing, a leverage arm removably carried by the retention device, the leverage arm being removably engagable with the handle, the cover in the closed position being structured to resist removal of the leverage arm from the retention device, and the cover in the open position being structured to permit removal of the leverage arm from the retention device.

Another aspect of the invention is to provide a retention device for removably carrying a leverage arm on a switchgear cabinet, the switchgear cabinet including a housing and a cover, the cover extending outwardly from the housing, in which the general nature of the retention device can be stated as including a mounting member, the mounting member being structured to be mounted on the housing of the switchgear cabinet, and a tab structured to extend outwardly from the housing.

Still another aspect of the present invention is to provide a method for controlling the removability of a leverage arm from a housing of a switchgear cabinet, the general nature of which can be stated as including the steps of providing a retention device mounted on the housing, the retention device including a mounting member and a tab, removably carrying the leverage arm on the retention device, mounting a cover on the housing, the cover being movable between a closed position and an open position, and resisting removal of the leverage arm from the retention device with the cover in the closed position.

These and other aspect and advantages of the present invention will be more readily understood from the following description.

BRIEF DESCRIPTION OF THE DRAWINGS

Similar numerals refer to similar parts throughout the specification.

DESCRIPTION OF THE PREFERRED EMBODIMENT

A retention device 4 in accordance with the present invention is indicated generally in FIGS. 1–4. The retention device 4 is employed to removably retain a leverage arm 8 on a switchgear cabinet 10, the switchgear cabinet 10 including a circuit breaker 12 disposed therein. As will be set forth more fully below, the leverage arm 8 is attachable onto an operating mechanism that moves a plurality of moveable electrical contacts into an out of electrical contact with a corresponding plurality of stationary contacts within the circuit breaker 12.

Figure 1:
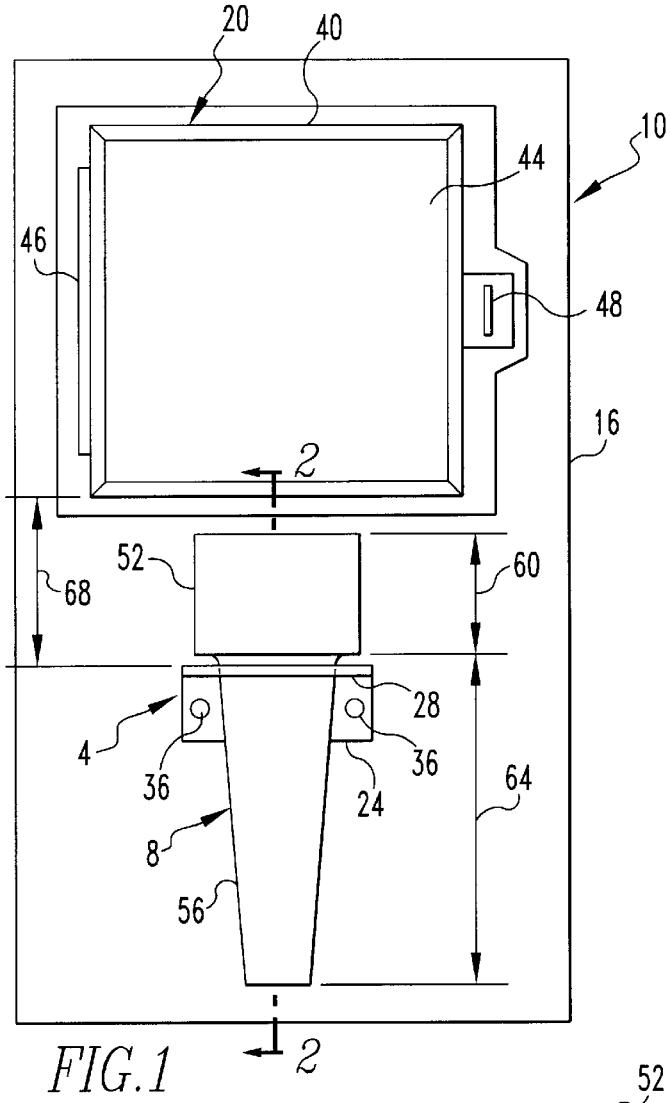
FIG. 1 is a front elevational view of a switchgear cabinet incorporating a retention device in accordance with the present invention and depicting a cover mounted on the switchgear cabinet and in a closed position.
Figure 3:
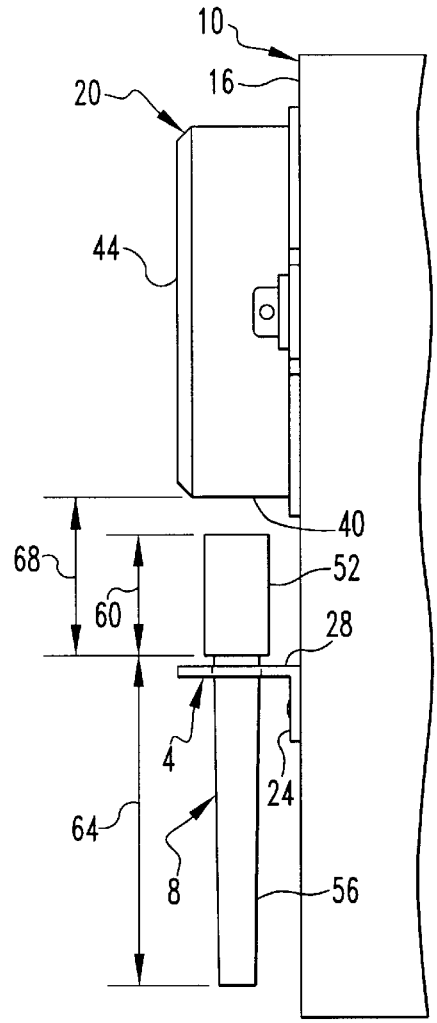
FIG. 3 is a side elevational view of the retention device.
Figure 2:
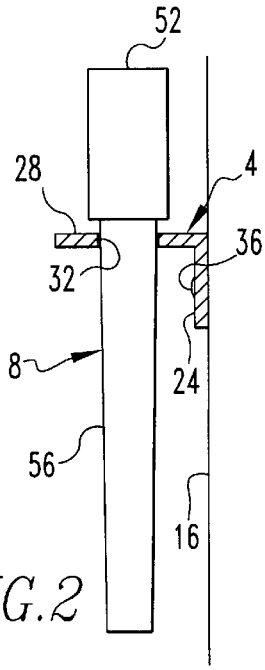
FIG. 2 is a sectional view as taken along line 2—2 of FIG. 1.
Figure 4:
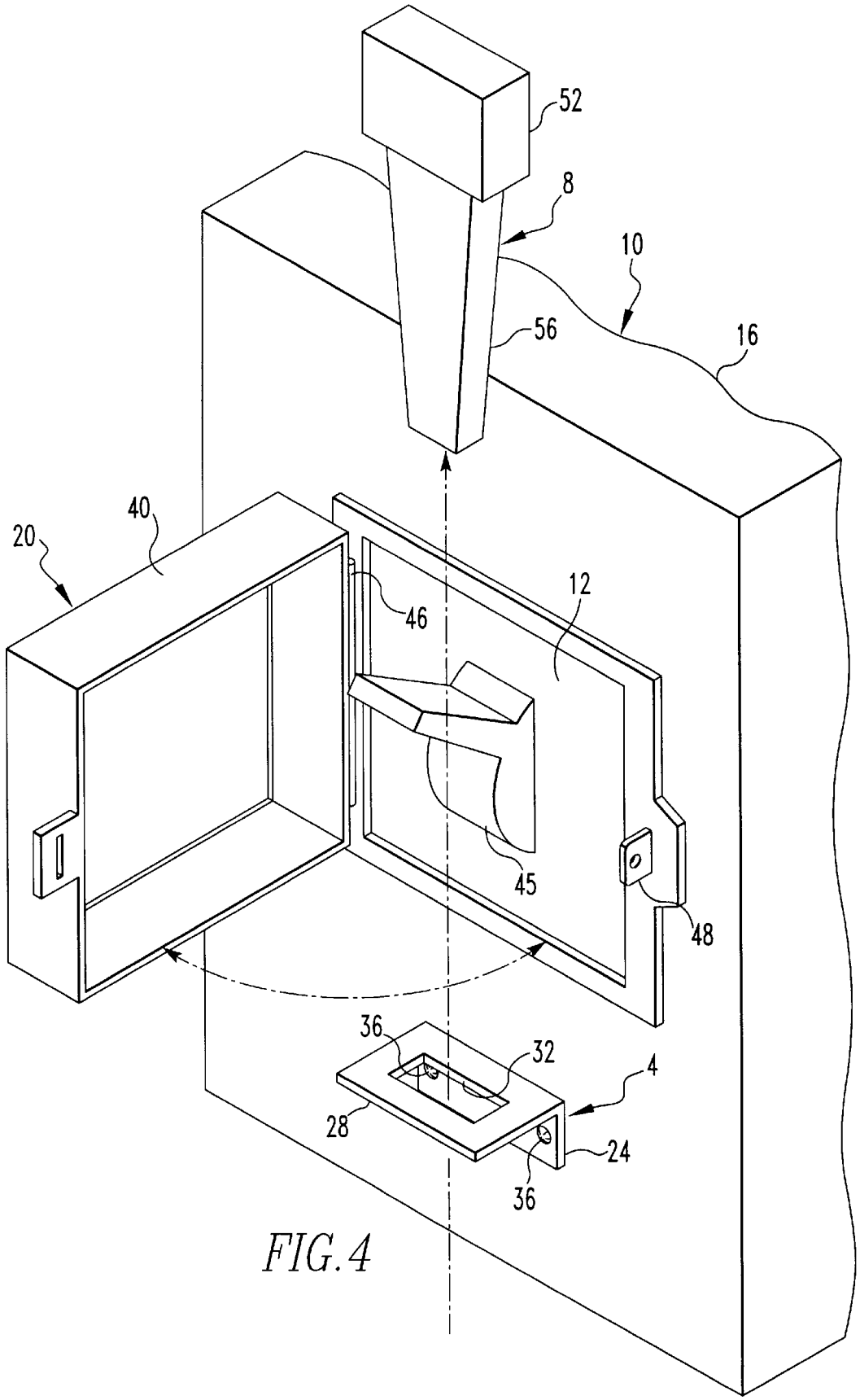
FIG. 4 is a front isometric view depicting the cover in an open position and further depicting removal of the leverage arm from the retention device.

The switchgear cabinet 10 includes a housing 16 that encloses and substantially retains therein the circuit breaker 12. The switchgear cabinet 10 additionally includes a cover 20 that is hingedly mounted on the housing 16 and protrudes outwardly therefrom. As is best shown in FIGS. 1 and 4, the cover 20 is moveable between a closed position (FIG. 1) and an open position (FIG. 4).

The retention device 4 includes a mounting member 24 that is fixedly mounted to the housing 16 of the switchgear cabinet 10 and a tab 28 extending from the mounting member 24 in a direction generally outward and away from the housing 16. The tab 28 is formed with an opening 32 that is sized to at least partially receive the leverage arm 8 therethrough, as will be set forth more fully below. The retention device 4 is attached onto the housing 16 with a pair of rivets 36, although other known attachment structures and methods may be used without departing from the spirit of the present invention.

In the embodiment depicted herein, the retention device 4 is manufactured out of a singular generally planar plate of material that is stamped or otherwise shaped into an approximate L-shape, the opening 32 being formed in the tab 28 prior to, during, or subsequent to forming the retention device 4 into its L-shape. The rivets 36 extend through holes formed in the mounting member 24 and securely mount the mounting member 24 flush against the housing 16. The opening 32 is disposed on the tab 28 such that one edge of the opening 32 is disposed adjacent or very near the housing 16.

The cover 20 includes a generally rectangular and planar security plate 44 and a sidewall 40 peripherally disposed on the security plate 44 and extending outwardly therefrom. A hinge 46 is disposed along one edge of the sidewall 40 and pivotably mounts the cover 20 onto the housing 16. As is understood in the relevant art, the hinge 46 permits the cover 22 to be selectively moved or pivoted between the closed and open positions.

The security plate 44 and the sidewall 40 extending outwardly therefrom together define a cavity that can receive a portion of the operating mechanism that protrudes outwardly from the housing 16 when the cover 20 is in the closed position. Nevertheless, the operating mechanism of the circuit breaker 12 need not protrude outwardly from the housing 16 and into the cavity formed in the cover 20 to achieve the beneficial aspects of the present invention so long as the leverage arm 8 is engagable with the operating mechanism.

The cover 20 maybe manufactured in any of a wide variety of appropriate methods and out of a wide variety of appropriate materials, although the cover 20 is most preferably molded out of a transparent or substantially translucent plastic material to enable a technician to observe the operating condition of the circuit breaker 12 through the transparent security plate 44.

As is understood in the relevant art, the operating mechanism includes a handle 45 or other component onto which the leverage arm 8 can be mounted. The handle 45 is moveable by the leverage arm 8 between an "on" condition in which the moveable contacts are in electrical engagement with the stationary contacts and an "off" condition in which the moveable contacts are out of electrical engagement with the stationary contacts. The circuit breaker 12 thus can function as a switch. The circuit breaker 12 can also be in a tripped position in which the moveable contacts have been moved out of electrical engagement with the stationary contacts due to the tripping mechanism acting on an overcurrent or other specified condition to disengage the moveable contacts from the stationary contacts to interrupt the flow of current through the circuit breaker 12. In this regard, it is understood that the leverage arm 8 can alternately be used in conjunction with a switch that is provided in the place of the circuit breaker 12 without departing from the spirit of the present invention.

The operating mechanism typically is configured such that the leverage arm 8 pivots the operating mechanism and its handle 45 between the "off" condition and the "on" condition, with the tripped condition of the handle 45 physically manifesting itself as being between the "o" and "on" conditions. As such, the specific position of the handle 45 is indicative of the "on", tripped, or "off" conditions of the circuit breaker 12, and the transparent or translucent character of the cover 20 enables a technician to observe therethrough the operating condition of the circuit breaker 12. Depending upon the specific needs of the particular application, however, the security plate 44 may or may not need to be transparent or translucent.

The cover 20 also preferably includes a locking structure 48 opposite the hinge 46 that selectively retains the cover 20 in the closed position. The locking structure 48 may include a locking tab that can receive a padlock thereon, or alternatively may include a lock cylinder operated by a key or other locking mechanism. It is understood, however, that other alternate locking mechanisms may be used without departing from the spirit of the present invention and may include non-locking retention structures that do not require a key or other security device to open.

The leverage arm 8 is an elongated member having a head 52 that is connected with a shank 56. As is best shown in FIG. 1, the head 52 has a given head length 60, and the shank 56 has a given shank length 64. The head length 60 and the shank length 64 are longitudinal dimensions measured longitudinally along the length of the leverage arm 8. The leverage arm additionally includes transverse dimensions that are measured in directions perpendicular to the longitudinal direction of the leverage arm 8.

The shank 56 is configured to generally have smaller transverse dimensions than the head 52. Moreover, the opening 32 includes transverse dimensions measured generally parallel with the plane of the tab 28. In this regard, the transverse dimensions of the opening 32 are sized to slidingly receive the shank 56 therein, yet are sized small enough that the head 52 has at least one transverse dimension that is larger than any transverse dimension of the opening 32, whereby the head 52 is resisted from passing through the opening 32.

The head 52 is specifically configured with the circuit breaker 12 to operatively engage the handle 45 of the operating mechanism thereof. In this regard, the head 52 can be formed with a socket to receive the handle 45 or may include pins or other apparatuses to operatively connect the head 52 of the leverage arm 8 with the handle 45 to permit the leverage arm 8 to operate the operating mechanism.

The retention device 4 is mounted on the housing 16 such that the tab 28 is spaced a given distance 68 away from the cover 20. The distance 68 is advantageously configured to be greater than the head length 60, yet is less than the combined head length 60 and shank length 64 of the leverage arm 8.

When the shank 56 is disposed in the opening 32 and the cover 20 is in the closed position, it can be seen that the cover 20 resists removal of the leverage arm 8 from the opening 32 inasmuch as the head 52 abuts the sidewall 40 and is in register therewith prior to removal of the shank 56 from the opening 32. As is best shown in FIG. 4, however, when the cover 20 is pivoted from the closed position to the open position, the sidewall 40 is removed from the path of the leverage arm 8 and is out of register therewith, which thus permits the leverage arm 8 to be removed from the opening 32.

It can be seen that the cover 20 is depicted herein as being mounted to the housing 16 with a hinge 46 that permits the cover 20 to be selectively pivoted between the closed and open positions, which selectively resists or permits removal of the leverage arm 8 from the retention device 4. It is understood, however, that the cover 20 may be configured to be selectively moved in other fashions between positions that resist and permit movement of the leverage arm 8, such as sliding or other such movements without departing from the spirit of the present invention.

It can thus be seen that the cover 20 in the closed position resists removal of the leverage arm 8 from the retention device 4, and thus retains the leverage arm 8 on the switchgear cabinet 10 and prevents theft or loss of the leverage arm 8. Additionally, when the operating mechanism of the circuit breaker 12 is to be manually operated by appropriate personnel, the cover 20 is pivoted from the closed position to the open position, thus exposing the handle 45 or other structure of the operating mechanism and simultaneously allowing removal of the leverage arm 8 from the retention device 4 for use in conjunction with the operating mechanism. As such, the cooperation of the cover 20 and the retention device 4 retains the leverage arm 8 in close conjunction with the switchgear cabinet 10 and with the circuit breaker 12, preventing theft and loss of the leverage arm 8, while making the leverage arm 8 available when the operating mechanism of the circuit breaker 12 is to be manually operated.

While a particular embodiment of the present invention has been described herein, it is understood that various changes, additions, modifications, and adaptations may be made without departing from the scope of the present invention, as set forth in the following claims.

I claim:

1. A switchgear cabinet comprising:

a housing;

a switch disposed in the housing, the switch including a handle;

a cover mounted on the housing, the cover being movable between a closed position and an open position, the cover extending outwardly from the housing;

a retention device mounted on the housing;

a leverage arm removably carried by the retention device, the leverage arm being removably engagable with the handle;

the cover in the closed position being structured to resist removal of the leverage arm from the retention device; and the cover in the open position being structured to permit removal of the leverage arm from the retention device.

2. The switchgear cabinet as set forth in claim 1, in which the retention device includes a mounting member and a tab, the mounting member being disposed against the housing, the tab extending outwardly from the housing.

3. The switchgear cabinet as set forth in claim 2, in which the tab is formed with an opening having at least a first transverse dimension, and in which the leverage arm includes a head and a shank, the shank extending through the opening when the leverage arm is mounted on the retention device.

4. The switchgear cabinet as set forth in claim 3, in which the cover in the closed position retains the head disposed between the tab and the cover.

5. The switchgear cabinet as set forth in claim 4, in which the switch is a circuit breaker.

6. The switchgear cabinet as set forth in claim 3 in which the head includes a transverse dimension that is greater than the at least first transverse dimension of the opening.

7. The switchgear cabinet as set forth in claim 3, in which the head is of a head length and in which the shank is of a shank length, the cover being spaced a distance away from the tab, the distance being at least the head length and no greater than the combined head and shank lengths.

8. The switchgear cabinet as set forth in claim 3, in which the cover includes a locking structure.

9. A retention device for removably carrying a leverage arm on a switchgear cabinet, the switchgear cabinet including a housing and a cover, the cover extending outwardly from the housing, the retention device comprising:

a mounting member, the mounting member being structured to be mounted on the housing of the switchgear cabinet; and a tab structured to extend outwardly from the housing.

10. The retention device as set forth in claim 9, in which the tab is formed with an opening.

11. A method for controlling the removability of a leverage arm from a housing of a switchgear cabinet, said method comprising the steps of:

providing a retention device mounted on the housing, the retention device including a mounting member and a tab;

removably carrying the leverage arm on the retention device;

mounting a cover on the housing, the cover being movable between a closed position and an open position; and resisting removal of the leverage arm from the retention device with the cover in the closed position.

12. The method as set forth in claim 11, in which the step of removably carrying the leverage arm on the retention device includes the step of retaining the leverage arm in an opening.

13. The method as set forth in claim 12, in which the step of retaining the leverage arm includes the step of slidably retaining the leverage arm in the opening.

14. The method as set forth in claim 11, in which the leverage arm includes a head having a head length and a shank having a shank length, and in which the step of resisting removal of the leverage arm includes the step of positioning the cover on the housing a distance from the tab, the distance being at least the head length and no greater than the sum of the head and shank lengths.

15. The method as set forth in claim 11, further comprising the step of moving the cover to the open position.

16. The method as set forth in claim 15, in which the step of moving the cover to the open position includes the step of permitting the leverage arm to be removed from the retention device.

17. The method as set forth in claim 15, in which the step of moving the cover to the open position includes the step of unlocking a locking structure.

* * * * *